US005375942A

United States Patent [19]

Lindley et al.

[11] Patent Number: 5,375,942

[45] Date of Patent: Dec. 27, 1994

[54] MATERIAL-LEVELING APPARATUS

[75] Inventors: Joseph Lindley, Paducah; Thomas R. Lindley, Boaz, both of Ky.

[73] Assignee: Lindley Incorporated, Paducah, Ky.

[21] Appl. No.: 7,492

[22] Filed: Jan. 25, 1993

Related U.S. Application Data

[63] Continuation-in-part of Ser. No. 892,244, Jun. 2, 1992, Pat. No. 5,244,305, which is a continuation-in-part of Ser. No. 619,497, Nov. 29, 1990, abandoned.

[51] Int. Cl.[5] ..... E01C 19/22

[52] U.S. Cl. ..... 404/97; 404/133.2

[58] Field of Search ..... 404/97, 133.2, 118, 404/119, 120

[56] References Cited

U.S. PATENT DOCUMENTS

| | | | |
|---|---|---|---|
| 919,993 | 4/1909 | Gaines | 404/118 X |
| 1,955,101 | 4/1934 | Sloan . | |
| 2,180,198 | 11/1939 | Day . | |
| 2,255,343 | 9/1941 | Baily . | |
| 2,303,335 | 12/1942 | Day . | |
| 2,314,985 | 3/1943 | Jackson . | |
| 2,372,163 | 3/1945 | Whiteman | 404/119 |
| 2,386,662 | 10/1945 | Crock . | |
| 2,400,321 | 5/1946 | Troxell . | |
| 2,651,980 | 9/1953 | Wells et al. . | |
| 2,746,367 | 5/1956 | Ferguson . | |
| 2,999,261 | 9/1961 | Lapham | 404/118 X |
| 3,427,939 | 2/1969 | Braff et al. . | |
| 3,883,259 | 5/1975 | Berg et al. . | |
| 3,917,426 | 11/1975 | Wohlwend et al. | 404/133.2 |
| 4,043,694 | 8/1977 | Mullen . | |
| 4,349,295 | 9/1982 | Morrison . | |
| 4,359,296 | 11/1982 | Cronkhite . | |
| 4,375,351 | 3/1983 | Allen . | |
| 4,386,901 | 6/1983 | Morrison . | |
| 4,388,018 | 6/1983 | Boschung . | |
| 4,408,978 | 10/1983 | Owens . | |
| 4,427,358 | 1/1984 | Stilwell | 404/119 X |
| 4,591,291 | 5/1986 | Owens . | |
| 4,641,995 | 2/1987 | Owens . | |
| 4,650,366 | 3/1987 | Morrison | 404/119 X |
| 4,685,826 | 8/1987 | Allen | 404/119 X |
| 4,758,114 | 7/1988 | Artzberger | 404/119 |
| 4,798,494 | 1/1989 | Allen . | |
| 4,838,730 | 6/1989 | Owens . | |
| 4,848,961 | 7/1989 | Rouillard . | |
| 4,861,188 | 8/1989 | Rouillard . | |
| 4,911,575 | 3/1990 | Tidwell . | |
| 5,096,330 | 3/1992 | Artzberger . | |
| 5,244,305 | 9/1993 | Lindley . | |

FOREIGN PATENT DOCUMENTS

| | | | |
|---|---|---|---|
| 141685 | 6/1951 | Australia | 404/119 |
| 1227346 | 8/1960 | France | 404/118 |
| 173454 | 11/1960 | Sweden | 404/118 |
| 613900 | 12/1948 | United Kingdom | 404/118 |
| 618510 | 2/1949 | United Kingdom | 404/119 |
| 2192418 | 1/1988 | United Kingdom | 404/118 |

OTHER PUBLICATIONS

L. Landberg, "Side-to-Side Action-Power screed produces uniform and level surface for finishing", Construction Equipment Innovations, Feb. 1991, one page.

Allen Engineering Corporation Advertising, Aberdeen's Concrete Source Book®-World of Concrete '92 Edition, vol. 9, 1992, pp. C155-C157.

Cronkhite Industries, Inc. Advertising, Aberdeen's Concrete Source Book®-World of Concrete '92 Edition, vol. 9, 1992, one page.

Metal Forms Corporation Advertising, Aberdeen's Concrete Sourcebook®-World of Concrete '92 Edition, vol. 9, 1992, pp. C342-C343.

Morrison, Division of amida Industries, Inc. Advertising, Aberdeen's Concrete Sourcebook®-World of Concrete '92 Edition, vol. 9, 1992, one page.

Burke® Advertising, Aberdeen's Concrete Sourcebook®-World of Concrete '92 Edition, vol. 9, 1992, one page.

Construction Methods and Equipment, Apr. 1952 p. 13.

*Primary Examiner*—Mark Rosenbaum

*Assistant Examiner*—Frances Han

*Attorney, Agent, or Firm*—Barnes & Thornburg

[57] ABSTRACT

A concrete striking equipment presented in the form of a framework mounted on a longitudinal bar operating in a vibratory relationship in a horizontal plane because of an off-center rotating weight defining a part of the powering means. While basically developed for striking concrete, the invention's field of utility extends to the leveling and/or grading of earth and rock.

21 Claims, 1 Drawing Sheet

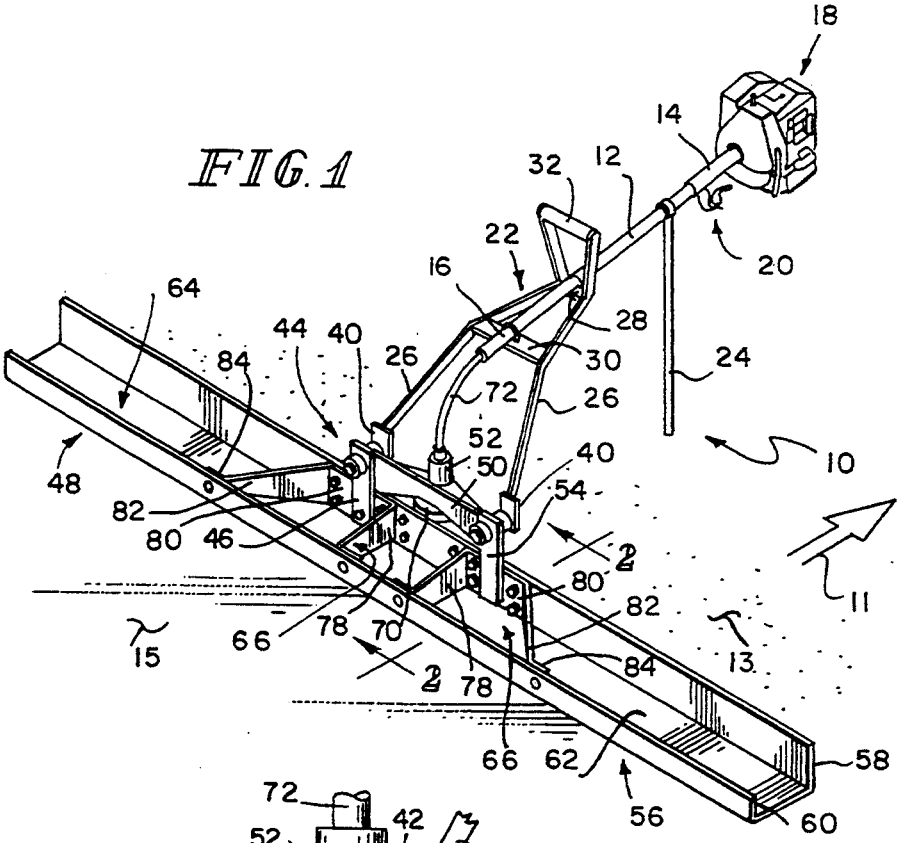
FIG. 1
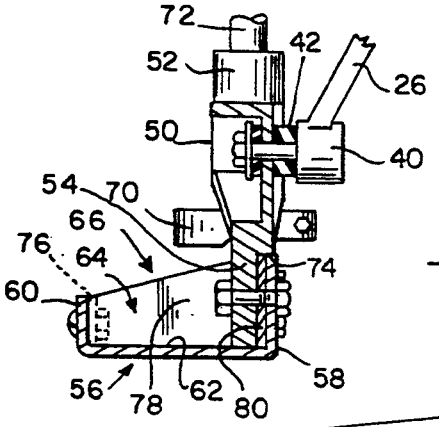
FIG. 2
FIG. 3
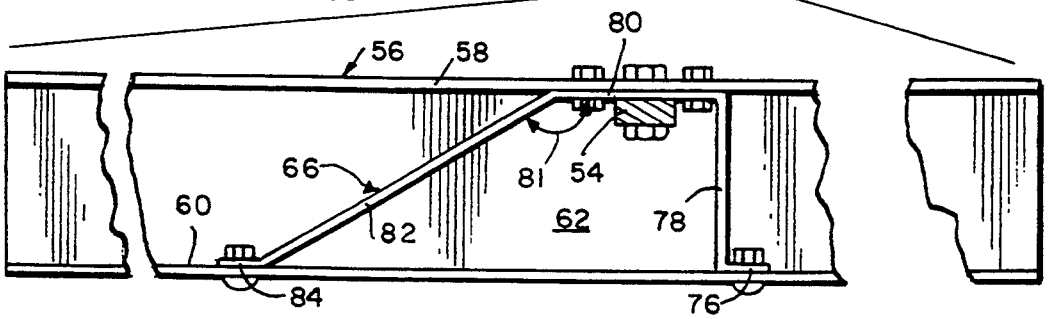

MATERIAL-LEVELING APPARATUS

The present application is a continuation-in-part of U.S. patent application Ser. No. 07/892,244, filed Jun. 2, 1992, now U.S. Pat. No. 5,244,305, which is a continuation-in-part of U.S. application Ser. No. 07/619,497, filed Nov. 29, 1990, now abandoned.

BACKGROUND AND SUMMARY OF THE INVENTION

The present invention relates to portable screeds for use in leveling materials, such as loose gravel or wet concrete, and particularly to a material-leveling apparatus for use with a portable screed. More particularly, the invention relates to a material-leveling apparatus for use with a portable screed that includes an off-center weight rotating about a vertical axis so as to impart horizontal movement to the material-leveling apparatus.

After concrete is initially laid, it must be worked while it is wet to provide a smooth, homogenous mixture. Working the concrete helps settle the concrete and helps to densify and compact the concrete during finishing. The working also removes air voids and brings excess water and fine layers of aggregate to the surface for subsequent finishing.

A typical procedure employed in connection with the placing of concrete involves strike-off, bull float, as for rock washdown and, finally, hand-finishing, typically involving the use of trowels and screeds. A screed is a leveling device drawn over freshly poured concrete. The foregoing procedure is time consuming and, therefore, a need has arisen for more rapidly leveling freshly poured concrete with professional quality results.

Generally, the working of wet concrete is accomplished by using screeds having various types of leveling boards or "straight edges" such as floaters, curl edge boards, finishing boards, strike-off boards, and the like. The material-engaging portion of a straight edge is largely dictated by the intended use in working or leveling dry or wet materials. For example, "floaters" are designed to "float" on the wet concrete without any external support, such as might be provided by wood or metal forms. Therefore, floaters are an example of straight edges that require a wider base surface than other straight edges that rely on wood or metal forms for supporting freshly poured concrete.

Some conventional straight edges include a horizontal base portion for floating on the wet concrete and a vertical leading edge which is coupled to a support frame. Typically, the horizontal base portion extends rearwardly from the leading edge and the entire horizontal base portion lies in one plane. It is known to provide an integral, outwardly angled rear edge which projects upwardly away from contact with the concrete, as disclosed in U.S. Pat. No. 4,798,494 to Allen.

The frame is typically coupled to the leading edge or horizontal base portion of the material-engaging portion. In the case of a powered screed including a vibration head having a rotatable off-center weight, rotation of the off-center weight generates vibration and causes movement of a straight edge mounted on the vibration head in a horizontal plane. We have observed that the horizontal movement of the vibrating straight edge causes the straight edge to flex, which induces stress in the straight edge. In a floater-type straight edge having a wide horizontal base portion, the vibration-induced stress is particularly strong at the trailing edge. This vibration-induced stress can lead to cracking, fracturing, and/or tearing of the straight edge and, ultimately, complete failure of the straight edge. This vibration-induced failure shortens the useful life of a straight edge and leads to increased costs as a result of a need to replace failed straight edges periodically. A straight edge having a wide horizontal base portion, for use as a floater, that would allow vibrating movement of the horizontal base portion in a horizontal plane while limiting the amount of vibration-induced stress acting at the trailing edge would reduce the likelihood of straight edge stress fracture, and thereby provide a substantial improvement over conventional straight edges.

According to the present invention, an improved material-leveling apparatus is provided for use with a powered screed of the type including a frame supporting a vibration head. An off-center weight is coupled to the frame so that it is able to rotate about a vertical axis and impart a horizontal movement to a material-leveling apparatus carried on the vibration head to level the material in process contacted by the vibrating material-leveling apparatus.

The straight edge includes a vertical leading edge, a vertical trailing edge, and a horizontal base portion extending therebetween. The leading and trailing edges cooperate with the base portion to define a channel extending along the length of the straight edge. A bracket for rigidifying the straight edge is positioned in the longitudinally extending channel and coupled to the leading and trailing edges of the straight edge to stiffen the straight edge.

In preferred embodiments, the stiffening bracket includes a pair of foot portions, a central body portion, and a pair of angled leg portions interconnecting the foot portions and the central body portion. Illustratively, each stiffening bracket is shaped so that each of the foot portions are flat vertical plates that conform to and mate with the flat inside wall of the vertical trailing edge of the straight edge. Bolts or the like are used to couple these foot portions to the vertical trailing edge. The central body portion of each stiffening bracket is also a flat vertical plate that abuts the vertical leading edge of the straight edge.

By providing a vertical trailing edge on a straight edge and a rigidifying bracket in a channel formed in the straight edge, the present invention greatly reduces the occurrence of stress cracking in straight edges. Thus, the present invention provides an improved material-leveling apparatus and thereby reduces the labor and material costs associated with replacing cracked straight edges used in screeds.

Additional objects, features, and advantages of the invention will become apparent to those skilled in the art upon consideration of the following detailed description of a preferred embodiment exemplifying the best mode of carrying out the invention as presently perceived.

BRIEF DESCRIPTION OF THE DRAWINGS

The detailed description particularly refers to the accompanying figures in which:

FIG. 1 is a perspective view of a portable screed having a frame and a vibration head on the frame and a material-leveling apparatus according to the present invention, showing a straight edge formed to include a short trailing edge, a wide horizontal base portion, a taller vertical leading edge, and a pair of rigidifying brackets mounted on the straight edge;

FIG. 2 is a sectional view taken along line 2—2 in FIG. 1 showing the attachment of a stiffening bracket to the leading and trailing edges of straight edge; and FIG. 3 is a broken plan view of the straight edge showing a stiffening bracket positioned in the channel of the straight edge and attached to the leading and trailing edges of the straight edge.

DETAILED DESCRIPTION OF THE DRAWINGS

A portable concrete screed 10 used for leveling freshly poured concrete is shown in FIG. 1. Portable concrete screed 10 can be maneuvered manually by a single worker to level various types of wet and dry materials. The portable screed 10 includes a frame 22, a motor 18 mounted on one end of the frame 22, and an material-leveling apparatus 48 coupled to the opposite end of the frame 22. A vibratory drive system is mounted on the frame 22 and used to vibrate the material-leveling apparatus 48 in a horizontal plane once the motor 18 is turned on to allow an operator to level newly poured concrete using the portable screed 10. Illustratively, the vibratory drive system includes an off-center weight 70 that is rotated about a vertical axis 50 as to impart horizontal movement to the material-leveling apparatus 48.

In use, as shown in FIG. 1, an operator carrying the portable screed 10 can pull the screed 10 in direction 11 while the vibrating-leveling apparatus 48 floats on the freshly poured concrete 12 and the operator stands in the freshly poured concrete 13. This step allows the vibrating material-leveling apparatus 48 to grade the wet concrete 13 to produce a smooth finished concrete surface 15. In some cases, a material-leveling apparatus 48 can float directly on a bed of freshly poured concrete or rest on forms (not shown) used to collect freshly poured concrete in a predetermined location as during formation of a side walk.

As shown in FIG. 1, material-leveling apparatus 48 includes a specially shaped straight edge 56 and set of brackets or gussets 66 which mount to the straight edge 56 and cooperate to rigidify the material-leveling apparatus 48 during vibration of the material-leveling apparatus 48. As shown in FIG. 1, these brackets 66 are mounted on straight edge 56 to lie on opposite sides of the overlying rotatable off-center weight 70 included in the vibratory drive system.

As shown in FIG. 1, the portable screed 10 includes a tubular cable housing 12 having a leading end 14 and a trailing end 16. The leading end 16 is coupled to a motor 18 and a motor throttle control 20 and the trailing end 16 is coupled to a frame 22. A kickstand 24 is mounted on the tubular cable housing 12 between the throttle control 20 and the frame 22 at a point that allows an operator to use the kickstand 24 to support the screed 10 when it is not in use.

The frame 22 has a pair of diverging support arms 26 coupled together by a shoulder 28 and a cross brace 30. The tubular cable housing 12 is attached to the shoulder 28 and the cross brace 30 by U-bolts or other suitable fastening devices. Upper portions of the support arms 26 cooperate with the shoulder 28 and the cross brace 30 to rigidify an upper portion of the frame 22. Lower portions of the support arms 26 are angled to bend downwardly away from the rigidified upper portion of the frame 22 and support a mounting bracket 46.

An operator handle 32 is mounted on the frame 22 at shoulder 28 as shown in FIG. 1 to enable an operator to carry and maneuver the portable screed 10. Of course, the operator is able to grip the tubular cable housing 12 to steady and maneuver the portable screed 10 as it is being moved by the operator to level freshly poured concrete or any dry or wet material. The handle 32 can be integrally formed with the U-bolt that fastens the tubular cable housing 12 to the shoulder 28.

A pair of resilient vibration absorbers 42 are mounted on mounting bracket 46 and used to connect the trailing ends 40 of support arms 26 to the mounting bracket 46. These vibration absorbers 42 are rubber bushings or the like and are designed to minimize transfer of vibration from the mounting bracket 46 to the operator through the frame 22. Once the motor 18 is turned on, the off-center weight 70 carried on the mounting bracket 36 will rotate and impart horizontal vibration to the material-leveling apparatus 48 attached to mounting bracket 46. The vibration absorbers 42 function to block transfer of vibration to the operator using power screed 10.

The mounting bracket 46 includes a horizontal flange 50 bisected by a vertically oriented cylindrical neck 52 and a pair of legs 54 extending downwardly from the flange 50 to couple the mounting bracket 46. As shown in FIGS. 1 and 2, the off-center rotating weight 70 is appended to the neck 52 and the material-leveling apparatus 48 is mounted to the mounting bracket legs 54.

The material-leveling apparatus 48 includes a specially shaped straight edge 56. The illustrated straight edge 56 is designed to "float" on freshly poured concrete during use of the portable screed 10 to work the concrete. Other straight edges in accordance with the invention are used to "strike" materials to be leveled.

The straight edge 56 shown in FIGS. 1–3 has a vertical leading edge 58, a vertical trailing edge 60, and a horizontal base portion 62 situated therebetween. The horizontal base portion 62 cooperates with the leading and trailing edges 58 and 60 to define a longitudinally-extending channel 64. The straight edge 56 can be mechanically formed to produce the configuration shown in FIG. 1 by bending the leading and trailing edges 58, 60 perpendicularly to the horizontal base portion 62. Alternatively, it is within the scope of the invention to extrude the straight edge 56 to include an extruded leading edge 58 and an extruded trailing edge 60 having the same shape shown in FIGS. 1–3. Additionally, the leading edge 58 can include one or more forwardly facing projections of the type used to form a "curl edge" type straight edge. It is expected that straight edge 56 will typically be about 8–12 feet long when used in a portable screed 10 in a concrete floating application.

A plurality of brackets 66 or gussets are positioned in the longitudinally extending channel 64 to rigidify the straight edge 56. The brackets 66 are configured and mounted in channel 64 to strengthen straight edge 56 so as the reduce the incidence of fracturing and cracking that might otherwise occur when the straight edge 56 is vibrated in a horizontal plane to level dry or wet materials. The legs 54 of mounting bracket 46 are rigidly attached to the vertical leading edge 58 of the straight edge 56 as shown in FIGS. 1 and 2 and function to transmit vibration produced by rotating the off-center weight 70 relative to the mounting bracket 46 to the straight edge 56.

The off-center weight 70 is coupled to the mounting bracket 46 and supported for rotation in the cylindrical neck 52. A flexible drive cable 72 connects an input shaft of off-center weight 70 to an output shaft of the motor 18. Thus, the motor 18 functions to drive the flexible drive cable 72 which in turn rotates the off-center weight 70 about a vertical axis. Rotation of the off-center weight 70 imparts vibratory motion to the mounting bracket 46 which causes the straight edge 56 to move in a horizontal plane over the wet or dry material to be leveled, allowing an operator to work newly poured concrete using the portable screed 10. Reference is hereby made to Thomas R. Lindley's U.S. Pat. No. 5,244,305, entitled "Concrete Striking Equipment" for a detailed description of an off-center weight that is rotated to vibrate a conventional straight edge in a horizontal plane, which application is incorporated by reference herein. The material-leveling apparatus 48 of the present invention is well-suited for use with a portable screed of the type disclosed in that application.

The vibration absorbers 42 tend to isolate the support arms 26 and the rest of frame 22 from the horizontal movement of the straight edge 56. As illustrated in FIG. 2, the support arms 26 are coupled to the flange 50, but separated from direct contact with the flange 50 by the two vibration absorbers 42. The legs 54 extend downwardly from the flange 50 and are formed to include a shoulder 74 for engaging the straight edge 56.

Each bracket 66 is positioned in the channel 64 and attached to the leading and trailing edges 58 and 60, respectively as shown, for example in FIGS. 1 and 2. A central body portion 80 of the bracket 66 is situated to lie between the leading edge 58 and a leg 54 so that the same bolt or other attaching means can be used to attach the leg 54 and bracket 66 to the leading edge 58.

The position of bracket 66 in relation to the straight edge 56 and a leg 54 is shown in FIG. 3. The illustrative bracket 66 includes five portions. A first foot portion 76 is positioned in parallel abutment with the vertical trailing edge 60. A first leg portion 78 projects perpendicularly from the first foot portion 76 and extends across the channel 64 toward the vertical leading edge 58. A central body portion 80 extends perpendicularly from the first leg portion 78 to lie in parallel abutment with the vertical leading edge 58. A second leg portion 82 projects from the central body portion 80 at an angle 81 of about 150 degrees toward the leading edge 58 and extends across the channel 64 to connect with a second foot portion 84. The second foot portion 84 extends in parallel abutment with the trailing edge 60. The first foot, central body, and second foot portions 76, 80, and 84 provide vertical plates that are rigidly attached to their respective abutting vertical edges 58, 60, 58 by bolts or other suitable attaching means to enhance the rigidity of the straight edge portion 56.

Advantageously, it has been found during the development of this invention that the use of a vertical trailing edge 60 as shown in FIGS. 1–3 greatly diminishes the occurrence of stress cracking due to the rotation of the off-center weight 70. Excessive vibration will greatly shorten the operating life of a straight edge 56. Positioning at least one bracket 66 in the channel 64 and coupling it to the vertical leading and trailing edges 58, 60 in the manner disclosed herein further reduces the possibility that cracks, fractures, or stress-induced tears in the straight edge 56 will develop. It has also been found that orienting the second leg portion 82 of bracket 66 at an angle 81 of about 150 degrees with respect to the leading edge 58 of straight edge 56 also improves the resistance of the straight edge to stress. Thus, by combining the vertical trailing edge with a bracket that is coupled to the leading and trailing edges, and incorporating an angle of at least 150 degrees between the leading edge and the second leg portion, the improved material-leveling apparatus 48 of the present invention drastically reduces the occurrence of stress cracks the straight edge 56°

Advantageously, the material-leveling apparatus 48 is rigidified without relying on any welded joints or connections or awkwardly shaped connectors. By configuring the straight edge 56 to include a vertical trailing edge 60 it is possible to form the bracket 66 to include one or more vertical plates (e.g. first and second foot portions 76, 84) which conform to and mate against the inside wall of vertical trailing edge 60 when the bracket 66 is mounted in longitudinally extending channel 64 to stiffen and rigidify the straight edge 56. Illustratively, bolts or other fastening means are used to hold stiffening bracket 66 in place in channel 64 and in contact with the leading and trailing edges 58, 60 of straight edge 56. This design serves to rigidify straight edge 56 and reduce stress-induced tearing of the straight edge 56 even when the material-leveling apparatus 48 is used to level a dry material providing less resistance to vibration of the straight edges 56.

Although the invention has been described in detail with reference to certain preferred embodiments, variations and modifications exist within the scope and spirit of the invention as described and defined in the following claims.

We claim:

1. In a portable screed including a frame, a mounting bracket appended to the frame, material-leveling apparatus coupled to the mounting bracket, means for rotating an off-center weight relative to the frame about a vertical axis to impart horizontal vibration to the material-leveling apparatus, the improvement comprising the material-leveling apparatus including a straight edge having a vertical leading edge, a vertical trailing edge, and a horizontal base portion situated therebetween, and means for attaching the vertical leading edge to the mounting bracket so that the straight edge is coupled to the frame, the horizonal base portion interconnecting the leading and trailing edges to define a channel extending along the length of the straight edge, and means for rigidifying the straight edge to reduce the likelihood of occurrence of stress cracking in the straight edge caused by rotation of the off-center weight, the rigidifying means including at least one vertical plate and means for coupling the at least one vertical plate to the vertical trailing edge of the straight edge.

2. The improvement of claim 1, wherein the rigidifying means is positioned in the channel and coupled to the leading and trailing edges.

3. The improvement of claim 1, wherein the at least one vertical plate includes a first vertical plate oriented relative to the vertical leading edge to define an acute included angle therebetween.

4. The improvement of claim 3, wherein the at least one vertical plate further includes a second vertical plate oriented relative to the vertical leading edge to define a right angle therebetween.

5. The improvement of claim 1, wherein the coupling means includes a third vertical plate interconnecting the first and second vertical plates and abutting the vertical leading edge and means for mounting the third vertical plate to the vertical leading edge.

6. The improvement of claim 5, wherein the attaching means includes bolt means for connecting the mounting bracket to the vertical leading edge so that the third vertical plate is trapped between the mounting bracket and the vertical leading edge.

7. The improvement of claim 1, wherein the mounting bracket includes at least one vertical leg and the attaching means includes a bolt engaging the at least one vertical leg and the vertical leading edge.

8. The improvement of claim 7, wherein coupling means includes a mounting plate appended to the at least one vertical plate and positioned to lie between the at least one vertical leg and the vertical leading edge.

9. In a portable screed including a frame, a mounting bracket appended to the frame, a material-leveling apparatus coupled to the mounting bracket, means for rotating an off-center weight relative to the frame about a vertical axis to impart horizontal vibration to the material-leveling apparatus, the improvement comprising the material-leveling apparatus including a straight edge having a vertical leading edge including means for receiving the mounting bracket so that the frame is coupled to the straight edge, a vertical trailing edge, and a horizontal base portion situated therebetween, the horizontal base portion interconnecting the leading and trailing edges to define a channel extending along the length of the straight edge, and means for rigidifying the straight edge to reduce the likelihood of occurrence of stress cracking in the straight edge caused by rotation of the off-center weight, the rigidifying means including at least one vertical plate and means for coupling the at least one vertical plate to the vertical trailing edge of the straight edge, the rigidifying means being positioned in the channel and coupled to the leading and trailing edges, the rigidifying means including a bracket having a bottom edge positioned to abut the horizontal base portion.

10. In a portable screed including a frame, a mounting bracket appended to the frame a material-leveling apparatus coupled to the mounting bracket, means for rotating an off-center weight relative to the frame about a vertical axis to impart horizontal vibration to the material-leveling apparatus, the improvement comprising the material-leveling apparatus including a straight edge having a vertical leading edge including means for receiving the mounting bracket the frame is coupled to the straight edge a vertical trailing edge, and a horizontal base portion situated therebetween, the horizontal base portion interconnecting the leading and trailing edges to define a channel extending along the length of the straight edge, and means for rigidifying the straight edge to reduce the likelihood of occurrence of stress cracking in the straight edge caused by rotation of the off-center weight, the rigidifying means including at least one vertical and means for coupling the at least one vertical plate to the vertical trailing edge of the straight edge, the rigidifying means being positioned in the channel and coupled to the leading and trailing edges, the rigidifying means including a bracket having a plurality of bracket portions, a first bracket portion being coupled to the leading edge, a second bracket portion being coupled to the trailing edge, and a third bracket portion being coupled to, and extending between, the first and third bracket portions, and the second bracket portion including the at least one vertical plate.

11. The improvement of claim 10, wherein the bracket further includes a fourth bracket portion coupled to the trailing edge and a fifth bracket portion coupled to, and extending between, the first and fourth bracket portion, and the fourth bracket portion includes the at least one vertical plate.

12. The improvement of claim 11, wherein the third bracket portion extends perpendicularly to the leading and trailing edges and the fifth bracket portion cooperates with the leading and trailing edges to define an included angle of at least 150 degrees therebetween.

13. In a portable screed including a frame, a mounting bracket appended to the frame, a material-leveling apparatus coupled to the mounting bracket, means for rotating an off-center weight relative to the frame about a vertical axis to impart horizontal vibration to the material-leveling apparatus, the improvement comprising the material-leveling apparatus including a straight edge having a vertical leading edge including means for receiving the mounting bracket so that the frame is coupled to the straight edge, a vertical trailing edge, and a horizontal base portion situated therebetween, the horizontal base portion interconnecting the leading and trailing edges to define a channel extending along the length of the straight edge, and means for riqidifying the straight edge to reduce the likelihood of occurrence Of stress cracking in the straight edge caused by rotation of the off-center weight, the rigidifying means including at least one vertical plate and means for coupling the at least one vertical plate to the vertical trailing edge of the straight edge, a bracket being positioned in the channel and coupled to the trailing edge at the at least one vertical plate.

14. The improvement of claim 13, wherein the bracket includes first and fifth bracket portions coupled to the trailing edge, a third bracket portion coupled to the leading edge, a second bracket portion coupled to and extending perpendicularly between the first and third bracket portions, and a fourth bracket portion coupled to and extending between the third and fifth bracket portions.

15. The improvement of claim 14, wherein the fourth bracket portion cooperates with the trailing edge to define an included angle of about 150 degrees therebetween.

16. A screen comprising a frame, a rotatable off-center weight, means coupled to the frame for rotating the off-center weight about a vertical axis to produce vibration, material-leveling means for leveling a material in process, the material-leveling means being movable in a horizontal plane in response to exposure to vibration produced by rotation of the off-center weight about the vertical axis, means for rigidifying the material-leveling means to reduce the occurrence of stress cracking caused by the rotation of the off-center weight about the vertical axis, and means for coupling the material-leveling means to the frame, the coupling means being separate from the rigidifying means and engaging the material-leveling means and the frame.

17. A screed comprising a frame, a rotatable off-center-weight, means coupled to the frame for rotating the off-center weight about a vertical axis to produce vibration, material-leveling means coupled to the frame for leveling a material in process, the material-leveling means being movable in a horizontal plate in response to exposure to vibration produced by rotation of the off-center weight about the vertical axis, and means for rigidifying the material-leveling means to reduce the occurrence of stress cracking caused by rotation of the off-center weight about the vertical axis, the material-leveling means including a material-engaging portion having a horizontal base portion and a leading edge and the rigidifying means including a vertical trailing edge extending upwardly from the horizontal base portion, the leading and trailing edges cooperating with the horizonal base portion to define a longitudinally extending channel and the rigidifying means including a pair of brackets positioned in the horizontal longitudinally extending channel and each bracket being coupled to the vertical trailing edge.

18. The apparatus of claim 17, wherein the brackets include first portions coupled to the trailing edge so as to define an angle of at least 150 degrees therewith.

19. An apparatus for use in leveling fluid materials, the apparatus comprising a frame, a rotating off-center weight, motor means for rotating the off-center weight, the motor means being coupled to the frame, a straight edge coupled to the frame, wherein the straight edge includes a vertical leading edge, a horizontal base portion, and a vertical trailing edge, the leading and trailing edges extending upwardly at right angles from the horizontal base portion to define a U-shaped channel in the straight edge, means for coupling the off-center weight to the motor means to rotate the off-center weight about a vertical axis so as to impart horizontal vibrating movement to the straight edge, and means in the U-shaped channel for rigidifying the straight edge portion to reduce the likelihood of stress cracks caused by vibration generated by the rotation of the off-center weight about the vertical axis, the rigidifying means including at least one bracket positioned in the U-shaped channel and coupled to the vertical trailing edge.

20. An apparatus for use in leveling fluid materials, the apparatus comprising a frame a rotating off-center weight, motor means for rotating the off-center weight, the motor means being coupled to the frame, a straight edge coupled to the frame, wherein the straight edge includes a vertical edge, a horizontal base portion, and a vertical trailing edge, the leading and trailing edges extending upwardly at right angles from the horizontal base portion, means for coupling the off-center weight to the motor means to rotate the off-center weight about a vertical axis so as to impart horizontal vibrating movement to the straight edge, and means for rigidifying the straight edge portion to reduce the likelihood of stress cracks caused by vibration generated by the rotation of the off-center weight about the vertical axis, the rigidifying means including a bracket having a plurality of vertical portions and at least one of the vertical portions of the bracket is coupled to the vertical trailing edge.

21. The apparatus of claim 20, wherein the at least one portion of the bracket is coupled to the trailing edge and the at least one bracket portion cooperates with the trailing edge to define an included angle of at least 150 degrees therebetween.

* * * * *